US009304482B2

(12) United States Patent
Kato

(10) Patent No.: US 9,304,482 B2
(45) Date of Patent: Apr. 5, 2016

(54) IMAGE FORMING APPARATUS WITH DETACHABLE COMPONENTS

(71) Applicant: CANON KABUSHIKI KAISHA, Tokyo (JP)

(72) Inventor: Hiroshi Kato, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/611,560

(22) Filed: Feb. 2, 2015

(65) Prior Publication Data

US 2015/0220049 A1 Aug. 6, 2015

(30) Foreign Application Priority Data

Feb. 3, 2014 (JP) ..... 2014-018378

(51) Int. Cl.
*G03G 15/04* (2006.01)
*G03G 21/16* (2006.01)
*G03G 21/18* (2006.01)

(52) U.S. Cl.
CPC ..... *G03G 21/1633* (2013.01); *G03G 21/1647* (2013.01); *G03G 21/1676* (2013.01); *G03G 21/1821* (2013.01); *G03G 21/1853* (2013.01)

(58) Field of Classification Search
CPC ..... G03G 21/1623; G03G 21/1803; G03G 21/1842; G03G 21/1846; G03G 21/1853; G03G 2215/0665; G03G 21/1821; G03G 21/1676; G03G 21/1633; G03G 21/1647
USPC ..... 399/119, 111, 107, 113, 114, 125, 110
See application file for complete search history.

(56) References Cited

U.S. PATENT DOCUMENTS

| | | | |
|---|---|---|---|
| 5,607,602 | A | 3/1997 | Su et al. |
| 6,400,914 | B1 | 6/2002 | Noda et al. |
| 6,885,838 | B2 | 4/2005 | Kawai et al. |
| 6,999,696 | B2 | 2/2006 | Noda et al. |
| 7,092,655 | B2 | 8/2006 | Noda et al. |
| 7,231,161 | B2 | 6/2007 | Noda et al. |
| 7,248,814 | B2 | 7/2007 | Kawai et al. |
| 7,274,896 | B2 | 9/2007 | Kawai et al. |
| 7,403,733 | B2 | 7/2008 | Watanabe et al. |

(Continued)

FOREIGN PATENT DOCUMENTS

| | | | |
|---|---|---|---|
| JP | H10-240103 | A | 9/1998 |
| JP | 02875208 | B2 | 3/1999 |
| JP | 2010-085797 | A | 4/2010 |

*Primary Examiner* — Billy Lactaoen
(74) *Attorney, Agent, or Firm* — Fitzpatrick, Cella, Harper & Scinto

(57) ABSTRACT

An image forming apparatus for forming an image on a recording material includes a drum cartridge including an image bearing member, a developing cartridge including a developing unit for developing the image formed on the image bearing member, and a cartridge mounting member to which the drum cartridge and the developing cartridge are detachably mountable. In addition, a transferring unit transfers a visualized image on the image bearing member onto the recording material fed along a feeding path, and an opening and closing cover is provided across the feeding path from the image bearing member. A path of removing the detachable developing cartridge is accessed by opening the opening and closing cover and extends across the feeding path so as to permit the developing cartridge to pass through the feeding path without removing the drum cartridge.

10 Claims, 10 Drawing Sheets

(56) References Cited

U.S. PATENT DOCUMENTS

| | | | | |
|---|---|---|---|---|
| 7,489,885 | B2 | 2/2009 | Noda et al. | |
| 7,630,661 | B2 | 12/2009 | Noda et al. | |
| 7,660,545 | B2 | 2/2010 | Noda et al. | |
| 7,920,806 | B2 | 4/2011 | Noda et al. | |
| 8,725,042 | B2 | 5/2014 | Watanabe et al. | |
| 2002/0018666 | A1 | 2/2002 | Noda et al. | |
| 2004/0085431 | A1* | 5/2004 | Asuwa | G03G 15/0121 347/129 |
| 2007/0092270 | A1* | 4/2007 | Inukai | 399/13 |
| 2007/0104511 | A1 | 5/2007 | Kawai et al. | |
| 2009/0290908 | A1 | 11/2009 | Noda et al. | |
| 2010/0239312 | A1* | 9/2010 | Kikuchi et al. | 399/111 |
| 2011/0211863 | A1 | 9/2011 | Watanabe et al. | |
| 2013/0121722 | A1* | 5/2013 | Nakano | 399/110 |
| 2014/0205322 | A1 | 7/2014 | Watanabe et al. | |

* cited by examiner (a)

(b)

IMAGE FORMING APPARATUS WITH DETACHABLE COMPONENTS

FIELD OF THE INVENTION AND RELATED ART

The present invention relates to an image forming apparatus in which a cartridge is removably mountable.

Cartridges made up of various units different in service life have been in use for a long time. Generally speaking, a photosensitive drum, for example, is longer in service life than a development roller. Placement of components different in length of service life in different units, one for one, makes it possible to replace only the unit which contains the component necessary to be replaced. Thus, it can reduce an image forming apparatus in terms of cartridge cost. It can also contribute to efficient usage of natural resources.

On the other hand, demands have been increasing for image forming apparatuses which are better in terms of removal of a jammed sheet of recording medium. One of the structural arrangements for making it easier to remove a jammed sheet of recording medium from an image forming apparatus is to structure an image forming apparatus so that a user can easily access the jammed sheet of recording medium without removing a cartridge from the main assembly of an image forming apparatus. In recent years, image forming apparatuses have been substantially reduced in size. Thus, in order to make it easier to remove a jammed sheet of recording medium from the main assembly of an image forming apparatus, it has been studied to provide a door which can be rotationally opened to access the recording medium conveyance passage of the apparatus main assembly, from the opposite side of the recording medium conveyance passage from the cartridge in the apparatus main assembly.

For example, there has been disclosed in Japanese Laid-open Patent Application 2010-85797: Patent Document 1) an image forming apparatus structured so that its replaceable (consumable) components and supplies are placed in removable units, one for one. More specifically, the process cartridge employed by this image forming apparatus is structured so that it can be separated into a drum cartridge and a development cartridge after being moved out of the main assembly of the image forming apparatus.

SUMMARY OF THE INVENTION

According to an aspect of the present invention, an image forming apparatus for forming an image on a recording material includes a drum cartridge including an image bearing member; a developing cartridge including developing means for developing the image formed on said image bearing member; a cartridge mounting member to which said image bearing member cartridge and said developing cartridge are detachably mountable; transferring means for transferring a visualized image provided by said developing means on said image bearing member, onto the recording material fed along a feeding path; and an opening and closing cover provided across said feeding path from said image bearing member, wherein said cartridge mounting member is capable of permitting said developing cartridge to be mounted thereto and dismounted therefrom across the feeding path through an opening provided by opening said opening and closing cover, without removing said drum cartridge.

Further features of the present invention will become apparent from the following description of exemplary embodiments with reference to the attached drawings.

DESCRIPTION OF THE PREFERRED EMBODIMENTS

Hereinafter, preferred embodiments of the present invention are described. However, these embodiments are not intended to limit the present invention is scope.

Embodiment 1

Image Forming Apparatus

Figure 2:
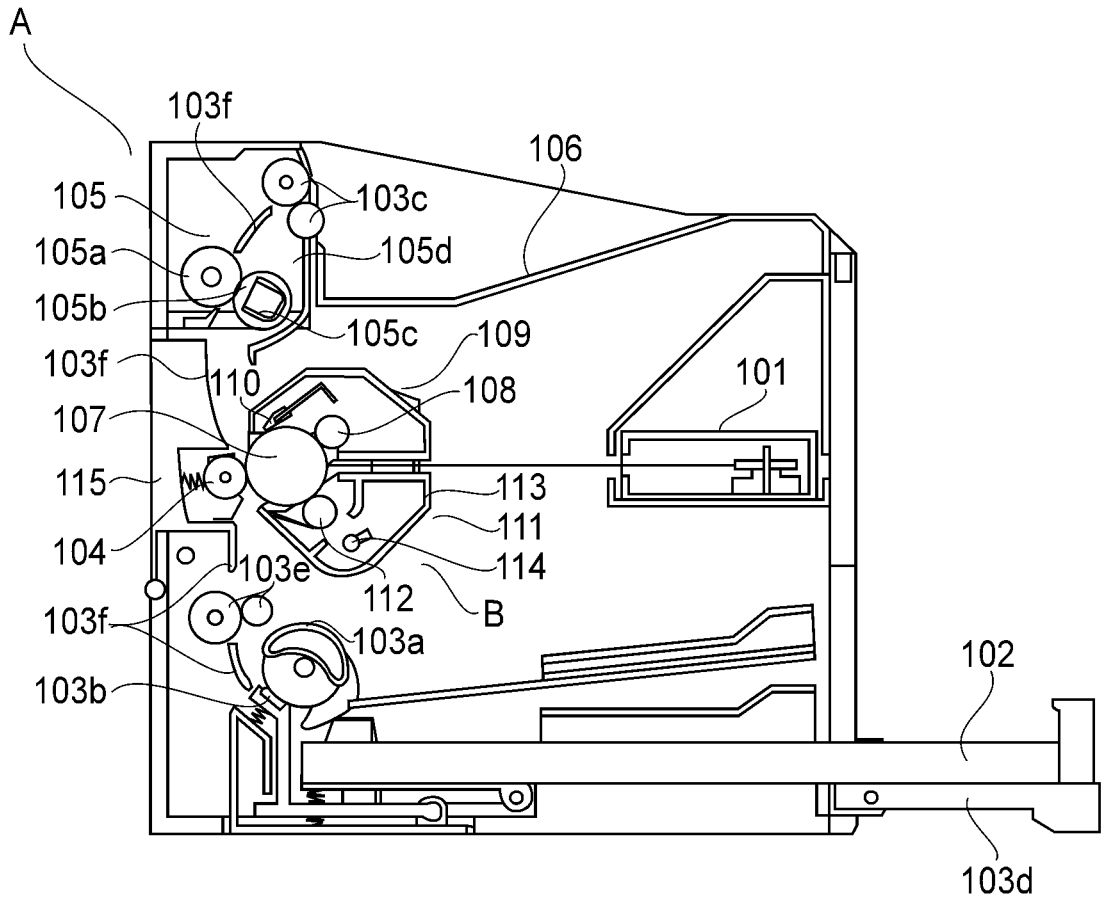
FIG. 2 is a schematic sectional view of the image forming apparatus, in the first embodiment, having the mechanism for removably mounting a cartridge.

FIG. 2 is a schematic sectional view of an image forming apparatus having a mechanism, in accordance with the present invention. Hereafter, this mechanism will be referred to as "cartridge mounting-dismounting mechanism" or "cartridge mounting and dismounting mechanism". It shows the general structure of the apparatus. The image forming apparatus in this embodiment is an electrophotographic image forming apparatus, more specifically, a laser beam printer. The main assembly A (which hereafter will be referred to as "image forming apparatus main assembly") employs an electrophotographic photosensitive member 107 (which hereafter will be referred to simply as "photosensitive drum"), which is an image bearing member and is in the form of a drum. The photosensitive drum 107 is uniformly charged by a charge roller 108 as a charging means. Then, a beam of light is projected upon the photosensitive drum 107 from an optical system 101, which is an optical means, while being modulated with the information of the image to be formed. Consequently, an electrostatic latent image is effected on the photosensitive drum 107. This electrostatic latent image is developed with developer (which hereafter is referred to as "toner") into a visible image, which is an image formed of developer (toner), and therefore, will be referred to as "toner image" hereafter.

While a toner image is formed, one of the sheets 102 of recording medium in a sheet feeding tray 103*d* is fed into the image forming apparatus main assembly by a combination of a pickup roller 103*a*, and a separating member 103*b* which is kept pressed upon the pickup roller 103*a*. Then, the sheet 102 is conveyed to a transfer position by a pair of sheet conveyance rollers 103*e*. In the transfer position, the toner image formed on the photosensitive drum 107 is transferred onto the sheet 102 by the application of voltage to a transfer roller 104 as a transferring means. After the transfer of the toner image onto the sheet 10, the sheet 102 is conveyed to a fixing means 105 by a sheet conveyance guide 103*f*.

In this embodiment, the fixing means 105 has a driving roller 105*a* and a rotational fixing member 105*d*. The rotational fixing member 105*d* has: an endless belt; a heater 105*b*, which is on the inward side of the endless belt; and a supporting member, by which the endless belt is rotatably supported. This fixing means 105 fixes the transferred toner image on the sheet 102 of recording medium by applying heat and pressure to the sheet 102 and the toner image thereon while the sheet 102 is conveyed through the fixing means 105. After the fixation of the toner image, the sheet 102 is conveyed further, and then, is discharged into a delivery tray 106 by a pair of discharge rollers 103*c*.

There are various fixing methods which can be used by the fixing means 105; the fixing method to be used by the fixing means 105 does not need to be limited to the above described one. In this embodiment, the sheet conveying means 103 is made up of the pickup roller 103*a*, separating member 103*b*, sheet conveyance roller 103*e*, discharge rollers 103*c*, etc.

Figure 3:
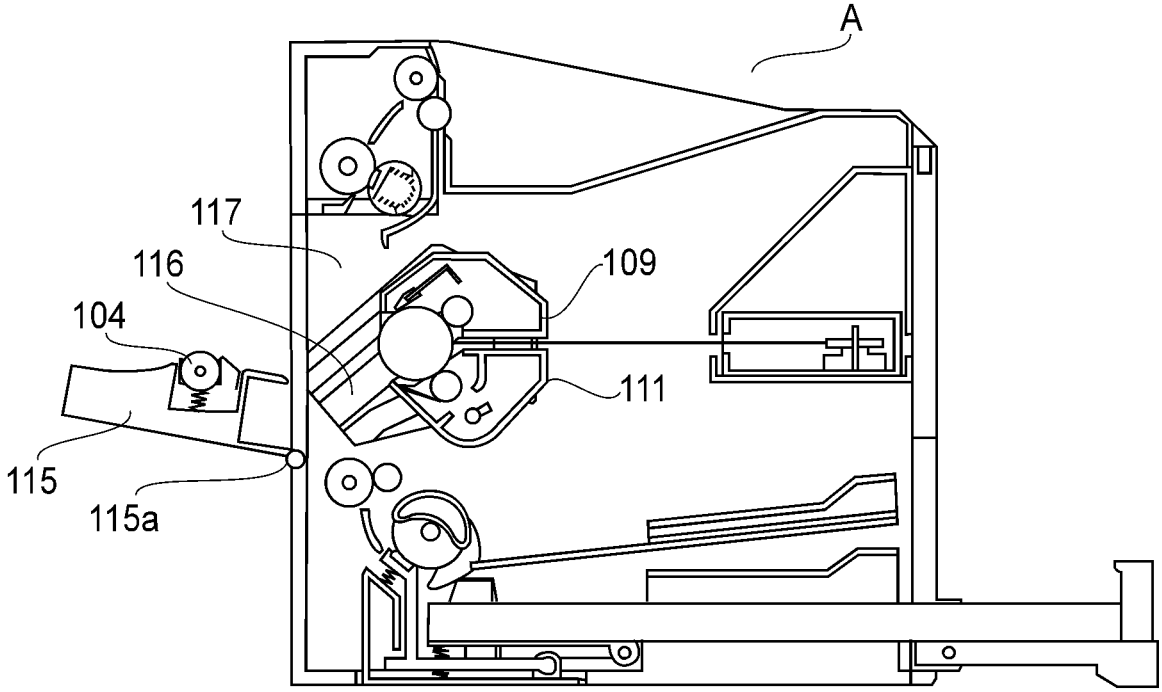
FIG. 3 is a schematic sectional view of the image forming apparatus, in the first embodiment, having the mechanism for removably mounting a cartridge, in which the cartridge is mounted into, or dismounted from, the main assembly of the image forming apparatus.

Referring to FIG. 3, the transfer roller 104 is held by a cover 115 which can be rotationally opened or closed by a user. Thus, the transfer roller 104 can be rotationally moved about the rotational axis 115*a* of the cover 115, along with the cover 115. That is, a user can open the cover 115 to replace the cartridge in the image forming apparatus main assembly, and also, to remove a jammed sheet in the main assembly.

The image forming apparatus main assembly A has the sheet conveying means 103, fixing means 105, and a driving means (unshown) for driving a process cartridge B (FIG. 2). The driving means (unshown) drives each of various rotational members by transferring the driving force from a motor (unshown), which is a driving force source, to the rotational member through gear trains (unshown).

It is also through the above described gear trains that the driving force is transmitted to the process cartridge B. Further, the driving force from the image forming apparatus main assembly A is transmitted to the process cartridge B by a coupling means such as the one disclosed in Japanese Patent 02875208, and Japanese Laid-open Patent Application H10-240103, for example.

The coupling means disclosed in these patent applications are made up of a main assembly coupling and a cartridge coupling. The main assembly coupling has a helical hole, which is coaxial with the output gear shaft of the above-described gear train, and the cross section of which is roughly in the form of an equilateral triangle. The cartridge coupling has a helical protrusion the cross-section of which is roughly in the form of an equilateral triangle. Thus, the above described coupling means can be coupled or uncoupled by moving the main assembly coupling in the lengthwise direction of the photosensitive drum 107, or the lengthwise direction of the development roller 112 which is described later.

Coupling of the main assembly coupling with the cartridge coupling causes the driving force transmitting portion of the image forming apparatus main assembly A to align with the driving force transmitting portion of the cartridge B, and also, to precisely position the image forming apparatus main assembly A and cartridge B relative to each other. In this embodiment, therefore, the image forming apparatus is provided with a means (unshown) for coupling or uncoupling this coupling means.

(Cartridge)

Next, referring to FIG. 2, the process cartridge B is described. The process cartridge B in this embodiment is made up of a drum cartridge 109, and a development cartridge 111, which can be independently mounted into, or dismounted from, the image forming apparatus main assembly A, from each other.

The drum cartridge 109 integrally holds: the photosensitive drum 107 which is an electrophotographic photosensitive member as an image bearing member; charge roller 108 which charges the peripheral surface of the photosensitive drum 107; a cleaning device 110 which removes the residual toner image on the photosensitive drum 107 and recovers the removed toner; etc.

As for the development cartridge 111, it has a development roller 112 which is a developing means for developing an electrostatic latent image on the photosensitive drum 107 into a visible image. Further, the development cartridge 111 has a toner storage 113 in which the toner to be supplied to the development roller 112 is stored; multiple stirring members 114 for stirring the toner delivered from the toner container; and the like members.

(Mechanism for Mounting or Dismounting Cartridge)

Figure 4:
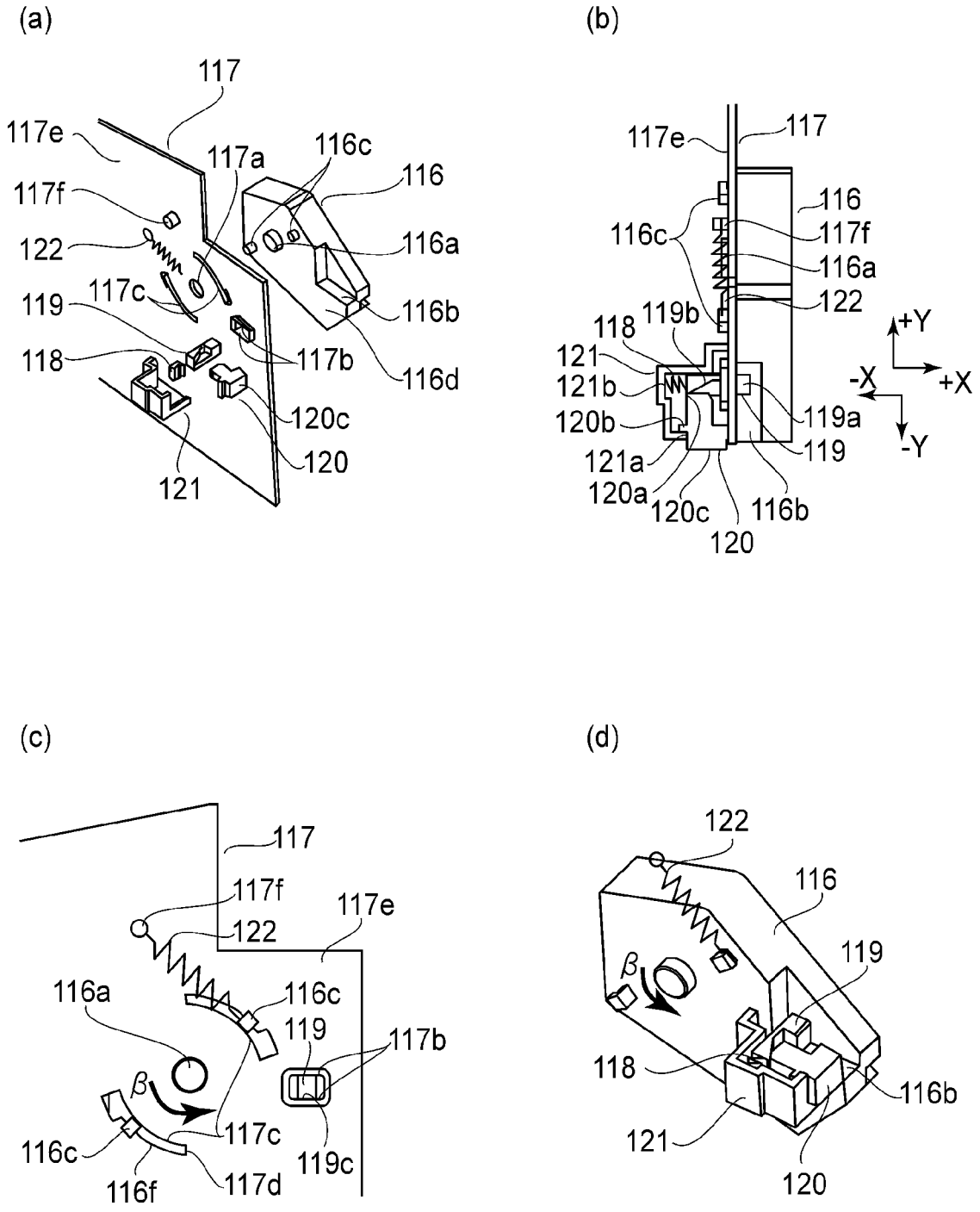
FIG. 4 is a detailed drawing of the mechanism, in the first embodiment, for removably mounting a cartridge.

Next, the structure of the above-mentioned mechanism for mounting or dismounting a cartridge is described. FIG. 4(*a*) is an exploded perspective view of the mechanism, in this embodiment, for mounting or dismounting a cartridge, in this embodiment. The structural components shown in FIG. 4(*a*) are assembled as shown in FIG. 4(*d*) (FIG. 4(*b*) is a top view). The cartridge mounting-dismounting mechanism in this embodiment has: a cartridge guide 116 which holds the drum cartridge 109 and development cartridge 111; and main assembly lateral plate 117; and the first spring 122 which continuously applies pressure to the cartridge guide 116.

Further, the cartridge mounting-dismounting mechanism has: a rotation controlling member 119 which controls the cartridge holding member (116) in rotational movement; and the second spring 118 which continuously applies pressure to the rotation controlling member 119. Further, it has a unlocking member 120 which is for freeing the rotation controlling member 119; a holding member 121 which holds the second spring 118, rotation controlling member 119, and unlocking member 120, to the main assembly lateral plate 117.

By the way, FIG. 4(*c*) is an external side view of the cartridge mounting-dismounting mechanism, which shows only a cartridge guide 116, a part of the main assembly lateral plate 117, a rotation controlling member 119, and the first spring 122. The first spring 122 is held by the main assembly lateral plate 117. The position of the cartridge guide 116 in terms of the thrust direction is regulated (controlled) by the hook-shaped portion 116*c* of the cartridge guide 116, and the surface 117*e* of the main assembly lateral plate 117 (FIG. 4(*b*)).

Referring to FIG. 4(*a*), the supporting shaft 116*a* of the cartridge guide 116 is rotatably supported by the main assembly lateral plate 117 by being put through the hole 117*a* (axial line of which will coincide with supporting shaft 116*a*), with which the main assembly lateral plate 117 is provided. The hook-shaped portion 116*c* of the cartridge guide 116 remains under the pressure generated by the first spring 122 in the direction indicated by a referential code β in FIG. 4(*c*) in a manner to rotate the supporting shaft 116*a*.

Thus, the first controlling surface 116*b* of the cartridge guide 116 (FIG. 4(*a*)) remains in contact with the controlling surface 119*c* (FIG. 4(*c*)) of the rotation controlling member 119. Thus, the cartridge guide 116 remains precisely positioned during an image forming operation. That is, the cartridge guide 116 which guides the drum cartridge 109 and development cartridge 111 when they are mounted or dismounted, remain in the first position (image formation position) in the image forming apparatus main assembly A during an image forming operation.

The first controlling surface 116*b* of the cartridge guide 116, and the controlling surface 119*c* of the rotation controlling member 119 function as the positioning means for keeping the cartridge guide 116 in the first position.

Figure 1:
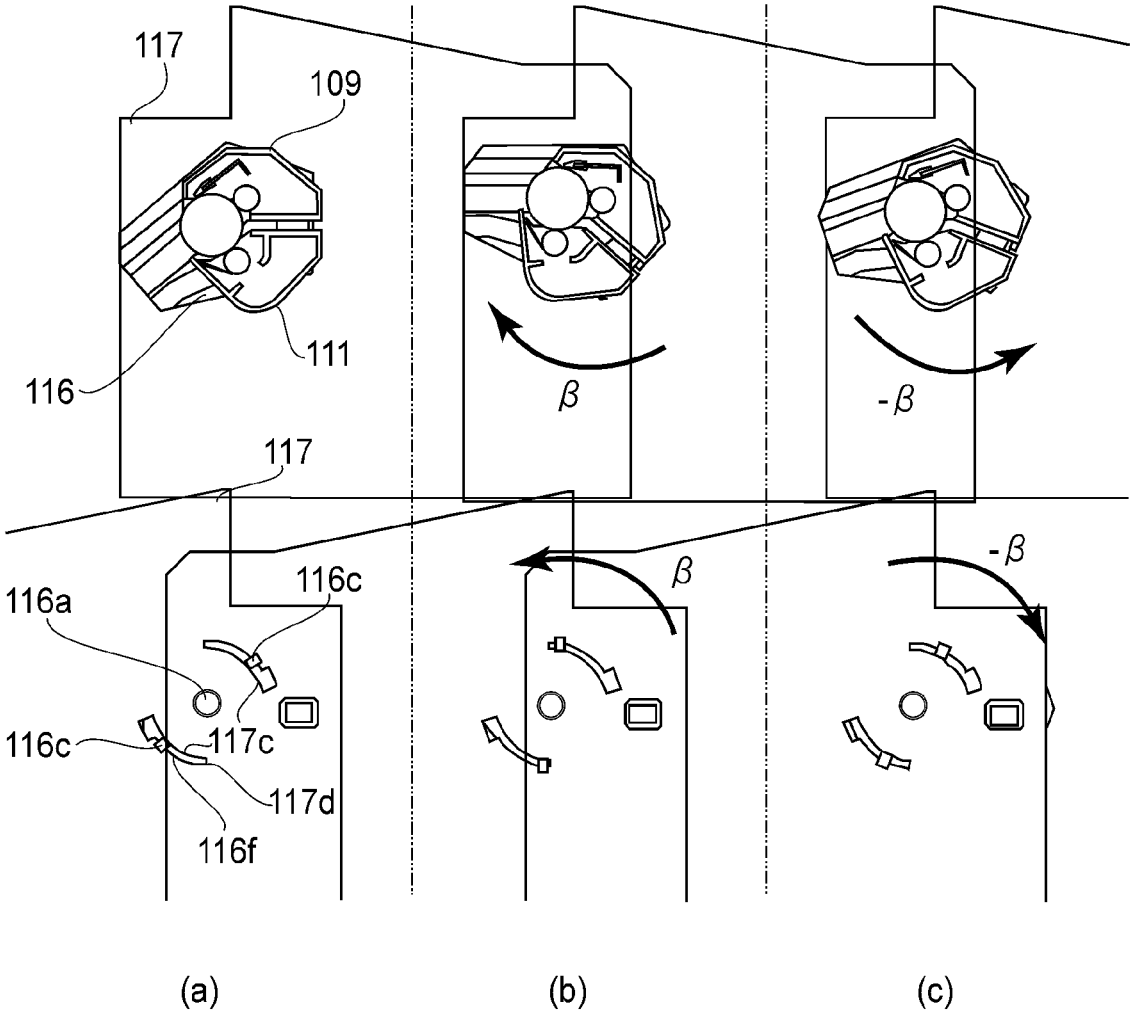
FIG. 1 is a drawing for describing the mechanism for removably mounting a cartridge, in the first embodiment of the present invention.

On the other hand, during a cartridge replacement operation, the rotation controlling member 119 (controlling surface 119*c*) is freed from the control placed thereon by the cartridge guide 116 (first controlling surface 116*b*). Thus, the cartridge guide 116 is rotated by the first spring 122 as shown in FIG. 1(*b*), as will be described later in detail. Thus, the second controlling surface 116*f* (FIG. (4(*c*)) of the cartridge guide 116 comes into contact with the controlling surface 117*d* (FIG. 4(*c*)), being thereby precisely positioned by the controlling surface 117*d*, through the curved guiding groove 117*c*, as a guiding portion, with which the main assembly lateral plate 117 is provided. That is, the cartridge guide 116 which is a cartridge mounting member is enabled to take the second position in which it allows the drum cartridge 109 and development cartridge 111 to be mounted or dismounted.

The second controlling surface 116*f* of the cartridge guide 116, and the controlling surface 117*d* of the main assembly lateral plate 117 function together as the positioning for positioning the cartridge guide 116 in the second position.

The rotation controlling member 119 comes into contact with the controlling surface 117*b* (FIG. 4(*b*)) of the main assembly lateral plate 117, being precisely position in terms of the vertical direction (top-bottom direction) in FIG. 4(*c*). As for its position in terms of the horizontal direction, the position of the rotation controlling member 119 is regulated by a combination of the unlocking member 120 and holding member 121, shown in FIG. 4(*b*).

Referring to FIG. 4(*b*), the rotation controlling member 119 remains under the pressure generated by the second spring 118 in the direction indicated by an arrow mark +X. Thus, the slanted surface 119*b* of the rotation controlling member 119 continuously presses the unlocking member 120 in the direction indicated by an arrow mark −Y. By the way, the disengagement prevention surface 120*b* (FIG. 4(*b*)) of the unlocking member 120 remains in contact with the holding member 121, preventing thereby the rotation controlling member 119 from disengaging in the direction indicated by the arrow mark −Y.

Referring to FIG. 4(*b*) which is a top view of the cartridge mounting-dismounting mechanism, the movement of the unlocking member 120 in the directions indicated by the arrow marks +X and −Y is controlled by the surface 117*e* of the main assembly lateral plate 117 and the surface 121*a* of the holding member 121. Further, the contacting surface 120*a* of the unlocking member 120 is in contact with the slanted surface 119*b* of the rotation controlling member 119. Thus, the pressing of the surface 120*c* of the unlocking member 120 by a user causes the rotation controlling member 119 to be moved in the direction indicated by the arrow mark −X against the resiliency of the second spring 118.

That is, the pressing of the surface 120*c* by a user in the direction +Y in FIG. 4(*b*) causes the rotation controlling member 119 (controlling surface 119*c*) to separate from the cartridge guide 116 (first controlling surface 116*b*), by being guided by the slanted surface 119*b* of the rotation controlling member 119. That is, the image forming apparatus main assembly A is structured so that as the cover 115 is opened, it becomes possible for a user to press the surface 120*c* of the unlocking member 120.

The unlocking member 120 (surface 120*c*) and rotation controlling member 119 (controlling surface 119*b*) function as a means for switching the position of the cartridge guide 116 from the first position to the second position.

(Cartridge Replacement Operation)

Next, the operation, in this embodiment, for replacing the cartridge in the image forming apparatus main assembly A is described. FIG. 1(*a*) shows the position of the cartridge guide 116 during an image forming operation. If it is necessary for a user to replace the cartridge in the image forming apparatus main assembly A, the user is to open the cover 115 and press the surface 120*c* shown in FIG. 4(*b*), by a preset amount. As the surface 120*c* is pressed, the rotation controlling member 119 moves in the direction indicated by the arrow mark −X in FIG. 4(*b*) until the rotation controlling member 119 separates from the cartridge guide 116.

As the rotation controlling member 119 separates from the cartridge guide 116, the cartridge guide 116 is rotationally moved by the first spring 122 in the direction β shown in FIG. 4(*c*), being thereby rotated until its second controlling surface 116*f* of the charging device 112 comes into contact with the controlling surface 117*d* of the main assembly lateral plate 117 (FIG. 4(*c*)). During this rotational movement of the cartridge guide 116, the attitude of the cartridge guide 116 changes into the one (in second position) shown in FIG. 1(*b*), in which the cartridge in the image forming apparatus main assembly A can be removed to be replaced.

By the way, until the cartridge guide 116 is returned into the position, in which it enables the image forming apparatus to form images, the rotation controlling member 119 remains under the pressure from the second spring 118, remaining therefore in contact with the surface 116*d* (FIG. 4(*a*)) of the cartridge guide 116. That is, the cartridge guide 116 remains free from the rotation controlling member 119.

In this embodiment, after the replacement of the development cartridge 111, a user is to directly push the cartridge guide 116 in the direction −β to rotate the cartridge guide 116. During this movement of the cartridge guide 116, the unlocking member 120 (surface 120*c*) and rotation controlling member 119 (controlling surface 119*b*) function as the means for switching the position of the cartridge guide 116 from the second position to the first position.

As the cartridge guide 116 is rotated into the position (FIG. 1(*a*)) in which it enables the image forming apparatus to form images, the rotation controlling member 119 becomes free from the surface 116*d* of the cartridge guide 116, which prevents the rotation controlling member 119 from moving in the direction indicated by the arrow mark +X in FIG. 4(*b*). Thus, the rotation controlling member 119 returns to the position shown in FIG. 4(*b*). Thus, the first controlling surface 116*b* of the cartridge guide 116 comes into contact with the controlling surface 119*c* of the rotation controlling member 119, whereby the cartridge guide 116 is kept in the position (first position) in which it allows the image forming apparatus to form images.

(Effects of Cartridge Mounting-Dismounting Mechanism in this Embodiment)

Lastly, the effects of the cartridge mounting-dismounting mechanism in this embodiment, structured as described above, is described after the above described issues are described in detail for the second time. To begin with, in order to make it easier for a user to remove a jammed sheet(s) of recording medium from an image forming apparatus, an image forming has to be structured so that a user can easily access the jammed sheet(s) of recording medium across the internal recording medium conveyance passage P of the image forming apparatus. That is, an image forming apparatus has to be structured so that the recording medium conveyance passage is positioned next to the cover 115 as shown in FIG. 5A.

Next, the position of the development roller 112 is regulated by the fact that it enables an image forming apparatus to form images. It is also regulated by the positional relationship between the development roller 112 and recording medium conveyance passage P. It is common practice to structure an image forming apparatus so that in terms of cross-sectional view, the center of the development roller 112 is positioned on the opposite side of a line which coincides with the center of the photosensitive drum 107 and is parallel to the recording medium conveyance passage P, as shown in FIG. 5A, for the purpose of reducing the main assembly of an image forming apparatus in height.

Figure 5A:
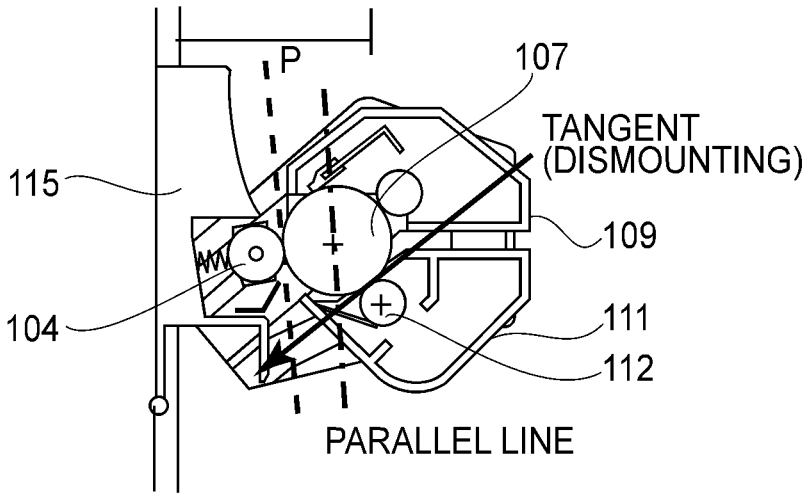
FIGS. 5A, 5B and 5C are illustrations of the process of removing a cartridge, in the first embodiment.

In FIG. 5A, the angle between the line which coincides with the point of contact between the photosensitive drum 107 (as image bearing member) and development roller 112 (developing means) and is tangential to the peripheral surface of the development roller 112 (photosensitive drum 107), and the recording medium conveyance passage P, is roughly 30 degrees, which is relatively large. In the case of an image forming apparatus structured as shown in FIG. 5A, in order to make it possible for a user to replace the developing device 4 independently from the drum cartridge 109, the image forming apparatus main assembly A and process cartridge B have to be structured so that the photosensitive drum 107 can be moved away downward from the development cartridge mounting-dismounting passage, as shown in FIG. 5A. This structural arrangement makes it necessary to increase the image forming apparatus main assembly A in size.

However, the cartridge mounting-dismounting mechanism in this embodiment is structured so that the cartridge guide 116 can be switched in position between the first position in which it enables the image forming apparatus to form images, and the second position in which it allows a user to replace the development cartridge 111, as described above. That is, in the case of the cartridge mounting-dismounting mechanism in this embodiment, the cartridge guide 116 makes it possible for the development cartridge 111 to be moved between the first and second positions. By the way, the cartridge guide 116 enables the drum cartridge 109 also to move between the first and second positions.

Figure 5B:
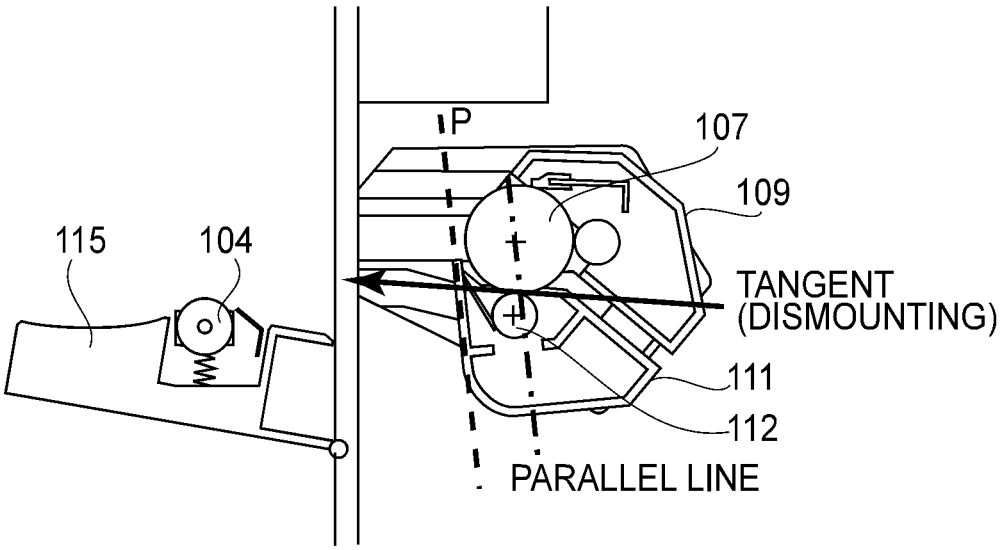

In this embodiment, the second position is set as shown in FIG. 5B, so that when the cartridge guide 116 is in the second position, it does not interfere with the other internal components. More specifically, the angle between the line which coincides with the point of contact between the photosensitive drum 107 and development roller 112 and is tangential to both the photosensitive drum 107 and development roller 112, and the line which is perpendicular to the recording medium conveyance passage P, is roughly 10 degrees, which is smaller than when it is during an image forming operation (first position in FIG. 5A). That is, when the cartridge guide 116 is in the second position, the development roller 112 is closer to the recording medium conveyance passage P than when the cartridge guide 116 is in the first position. In other words, the second position is such a position that the position in which the development roller 112 is when the cartridge guide 116 is in the second position is on the upstream side, in terms of the rotational direction of the photosensitive drum 107, of the position in which the development roller 112 is when the cartridge guide 116 is in the first position.

Also in this embodiment, the image forming apparatus is structured so that when the cartridge guide 116 is in the second position for cartridge mounting-dismounting (cartridge replacement), the center of the development roller 112, in terms of cross sectional, is on the same side as the line which is parallel to the recording medium conveyance passage P, in the adjacencies of the photosensitive drum 107, and coincides with the center of the photosensitive drum 107 in terms of cross sectional view. That is, the image forming apparatus is structured so that the rotational axis of the cartridge guide 116 coincides with the center of the circle which the theoretical extension of the above described curved guiding grooves 117*c* (guiding portion) forms.

Figure 5C:
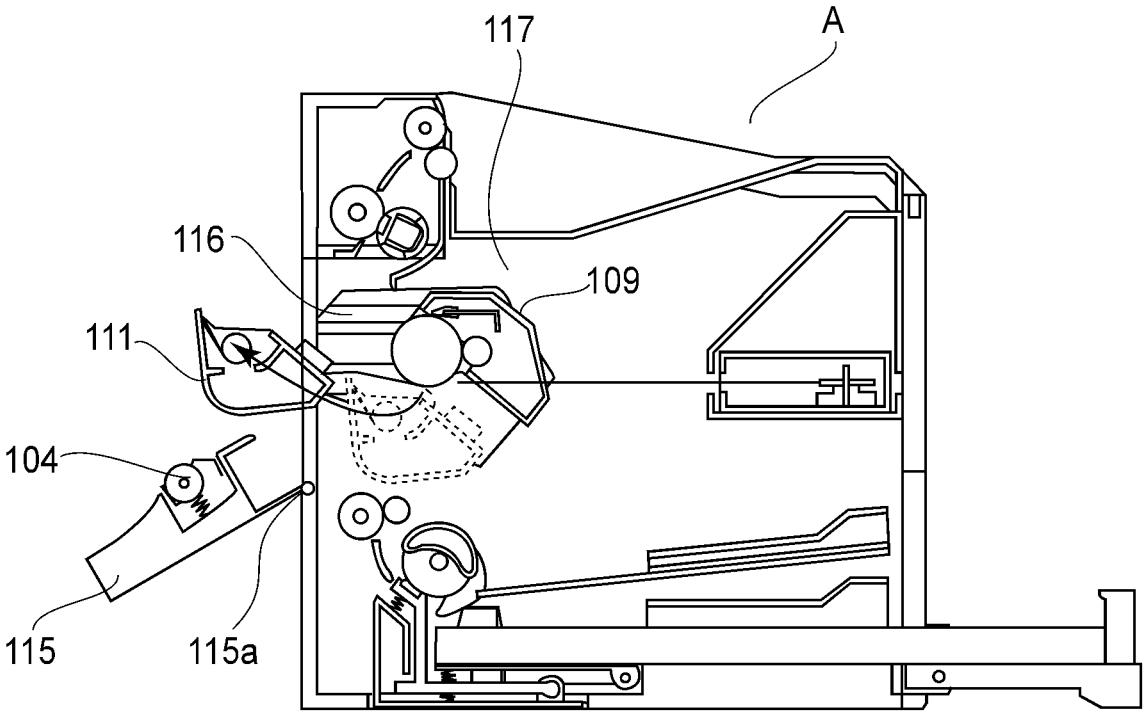

Thus, it is possible to realize a cartridge mounting-dismounting mechanism which enables a user to easily replace the development cartridge 111, independently from the photosensitive drum 107, across the recording medium conveyance passage P, through the opening which is exposed as the cover is opened, without increasing the image forming apparatus main assembly A in size, as will be understood from FIG. 5C.

Effects of this Embodiment

According to this embodiment, the drum cartridge 109 and development cartridge 111 which together make up the process cartridge B can be independently removed from the image forming apparatus main assembly A from each other, across the recording medium conveyance passage P. The direction in which the development cartridge 111 is removed, and the direction in which the drum cartridge 109 is removed, are the same (including roughly the same direction). That is, this embodiment makes it possible to replace the development cartridge 111 without removing the drum cartridge 109.

That is, this embodiment makes it unnecessary for the drum cartridge 109 of the process cartridge B which is a combination of the drum cartridge 109 and development cartridge 111, to be dismounted and remounted each time the development cartridge 111 needs to be replaced. Thus, it can improve an image forming apparatus and the process cartridge therefor in the efficiency with which a user can replace the development cartridge 111. Generally speaking, a development cartridge 111 needs to replaced more frequently than a drum cartridge. According to this embodiment, it is only when the drum cartridge has to be replaced that the drum cartridge has to be moved out of the image forming apparatus main assembly A. Thus, this embodiment can reduce the possibility that a photosensitive drum will be damaged by a user. Thus, this embodiment makes it unnecessary for the image forming apparatus main assembly A to be provided with a drum shutter with which a conventional image forming apparatus (process cartridge) is provided to prevent drum damage, making unnecessary the space for a drum shutter. Thus, this embodiment can reduce in size the image forming apparatus main assembly A as well.

Embodiment 2

Next, the second embodiment of the present invention, which causes an operation for mounting or dismounting at least one of drum cartridge and development cartridge, to switch in position a cartridge guide between the first and second positions, is described. By the way, the components, portions thereof, etc, of the image forming apparatus and process cartridge therefore in this embodiment, which are the same in structure as the counterparts in the first embodiment are given the same referential codes as those given to the counterparts, one for one, and are not described. That is, this embodiment is described about its differences from the first embodiment.

There are only two major differences between the first and second embodiments. One is that in this embodiment, the position of the cartridge guide is switched from the first one to the second one by the opening movement of the cover 215 with which the image forming apparatus main assembly A having a cartridge mounting-dismounting mechanism is provided, unlike in the first embodiment, in which the rotation controlling member 119 has to be directly pushed by a user. More concretely, in this embodiment, the image forming apparatus is provided with a cover 215 which can be rotationally opened or closed by a user, and a rotation controlling member 220. Further, the cover 215 is provided with a protrusion 215*b* (FIG. 7), and the image forming apparatus is structured so that as the cover 215 is opened or closed, the protrusion 215*b* causes the rotation controlling member 220 to move.

The second difference is that in this embodiment, the cartridge guide 216 is switched in position from the second one to the first one by the opening of the cover 215 of the image forming apparatus main assembly A having the cartridge mounting-dismounting mechanism by a user, whereas in the first embodiment, a user has to directly push the cartridge guide 116 in order to move the cartridge guide 116 from the cartridge replacement position (second position) to the image formation position (first position). That is, in this embodiment, the controlling surface 215*c* (FIG. 7) of the cover 215 is made to move the cartridge guide 216 by the closing movement of the cover 215. Otherwise, the image forming apparatus main assembly and process cartridge therefor, in this embodiment, are the same in structure and operation as the counterparts in the first embodiment.

Figure 6:
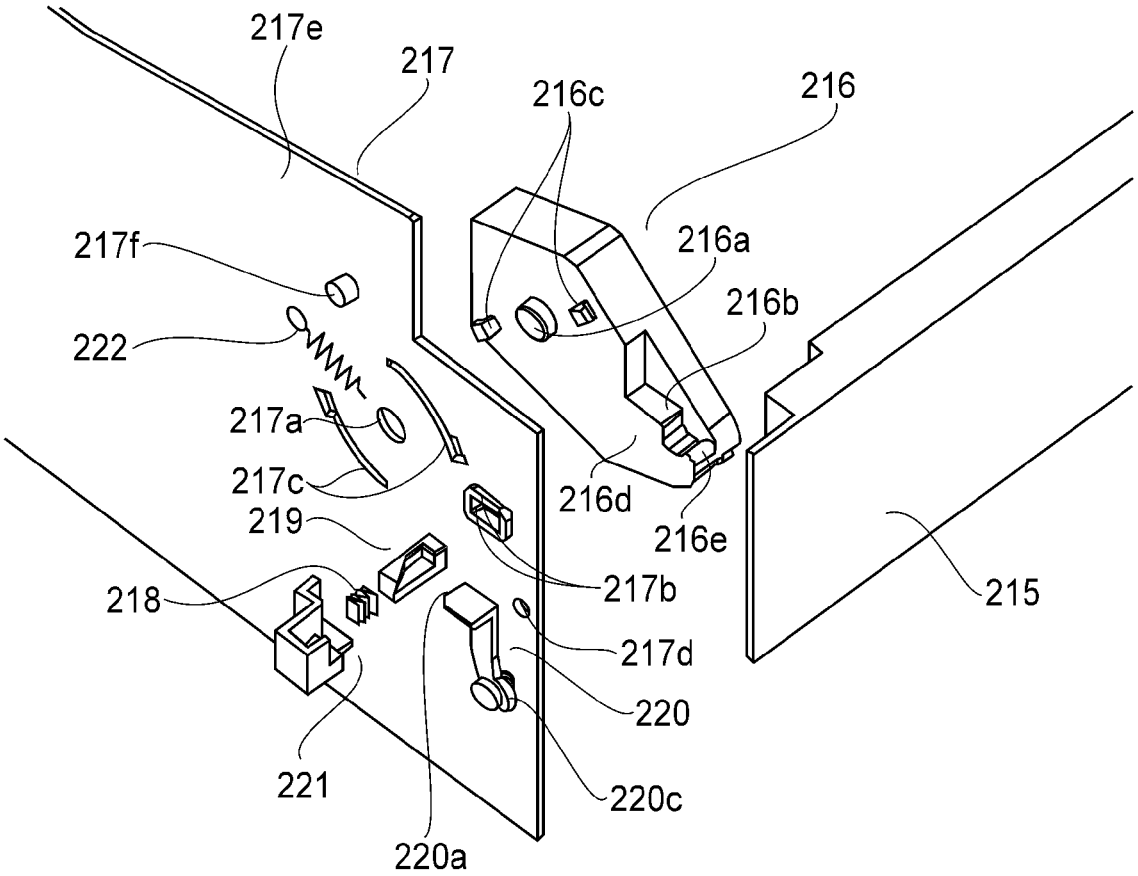
FIG. 6 is an exploded perspective view of the mechanism, in the second embodiment of the present invention, for removably mounting a cartridge.
Figure 7:
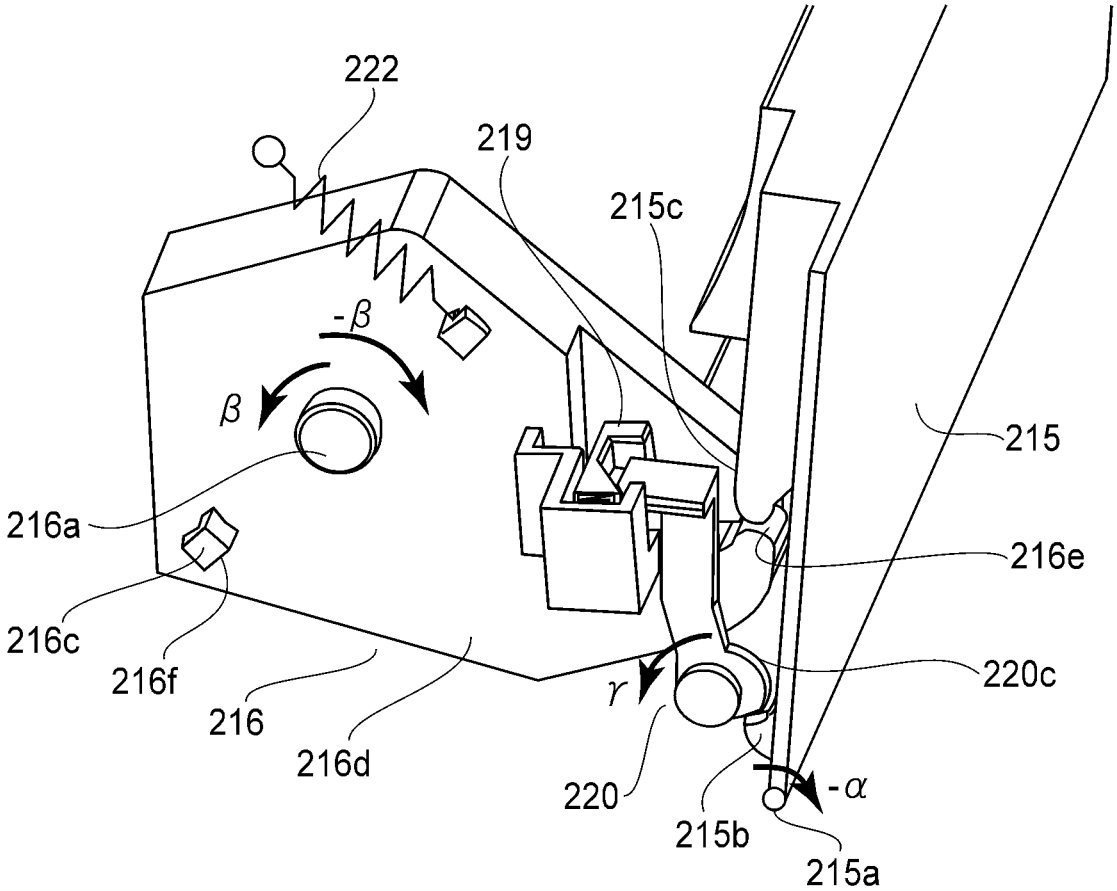
FIG. 7 is a perspective view of the mechanism, in the second embodiment, for removably mounting a cartridge.

FIG. 6 is an exploded perspective view of the cartridge mounting-dismounting mechanism in this embodiment. The components shown in FIG. 6 are assembled as shown in FIG. 7. The cartridge mounting-dismounting mechanism in this embodiment has: a cartridge guide 216; main assembly lateral plate 217; and the first spring 222 which presses on the cartridge guide 216. It has also: a rotation controlling member 219 which controls the rotational movement of the cartridge guide 216 in the image formation position (first position); a unlocking member 220 which unlocks the rotation controlling member 219; and a rotationally movable cover 215. Further, the unlocking member 220 is rotatably supported by the main assembly lateral plate 217, and has a cam surface 220*c*.

As a user rotationally moves the closed cover 215 by a preset angle in the opening direction, that is, the direction indicated by an arrow mark −α, the protrusion 215*b* of the cover 215 presses the cam surface 220*c* of the unlocking member 220, causing thereby the unlocking member 220 to rotationally move by a preset angle in the direction indicated by an arrow mark γ in FIG. 7. Consequently, the rotation controlling member 219 is prevented from preventing the cartridge guide 216 from rotationally moving in the direction indicated by the arrow mark R, as in the first embodiment.

Further, the cover 215 which can be rotationally opened or closed has a controlling surface 215*c*. Thus, as the cover 215 is rotationally moved in the closing direction by a user, the controlling surface 215*c* presses the surface 216*e* of the cartridge guide 216, causing thereby the cartridge guide 216 to rotationally move in the direction indicated by the arrow mark −β.

Figure 8:
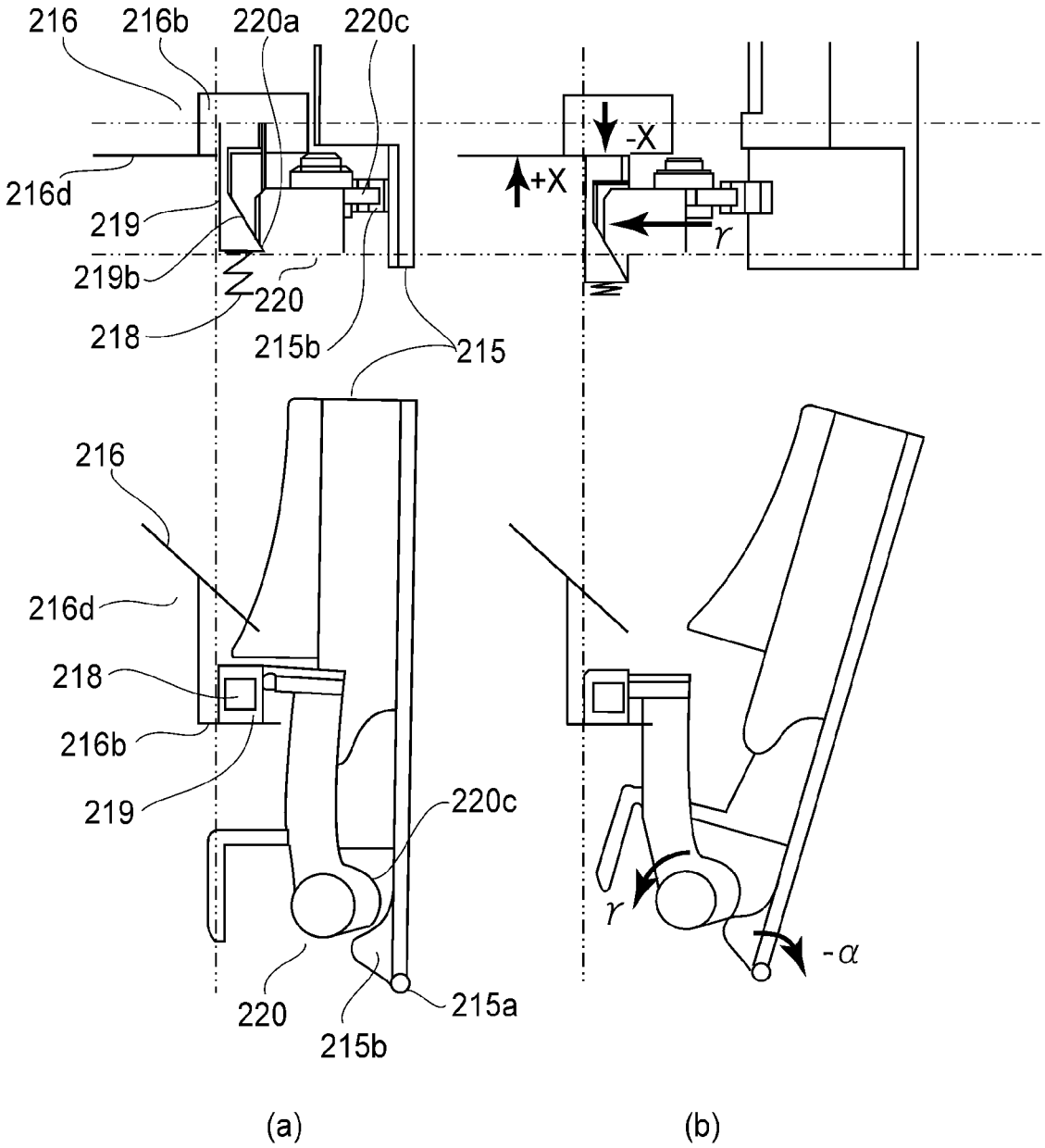
FIG. 8 is a drawing for describing the cover of the image forming apparatus, in the second embodiment, which can be rotationally opened or closed to remove a jammed sheet of recording medium.

Next, the operation of the cartridge mounting-dismounting mechanism in this embodiment is described. As the cover 115 is opened, the protrusion 215*b* of the cover 215 presses the cam surface 220*c* of the unlocking member 220, as shown in FIGS. 8 (*a*) and 8(*b*).

As a result, the rotation controlling member 219 is made to retreat in the direction indicated by the arrow mark −X against the resiliency of the second spring 218. Thus, the rotation controlling member 219 separates from the first controlling surface 216*b*, allowing thereby the cartridge guide 216 to move. Thus, the cartridge guide 216 is made to rotationally move in the direction β by the resiliency of the first spring 222.

As the cartridge guide 216 rotationally moves in the direction β, the rotation controlling member 219 which is under the pressure from the second spring 218 comes into contact with the surface 216*d* of the cartridge guide 216, being thereby prevented from moving in the direction +X. Then, as the cartridge guide 216 is rotationally moved by the preset angle, the second controlling surface 216*f* of the cartridge guide 216 comes into contact with the second controlling surface 217*d* of the main assembly lateral plate 217, being thereby positioned in the cartridge replacement position (second position).

Figure 9:
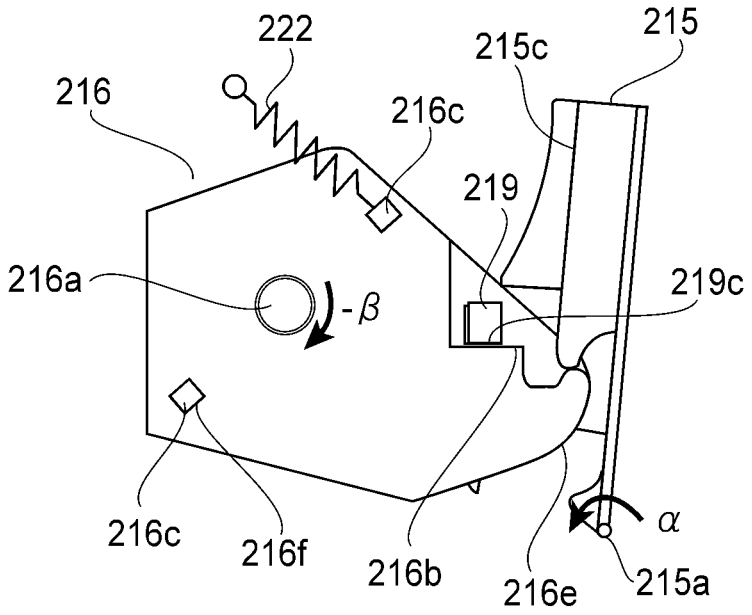
FIG. 9 is a drawing for describing the cartridge guide movement caused by the opening or closing movement of the cover, in the second embodiment.
Figure 9:
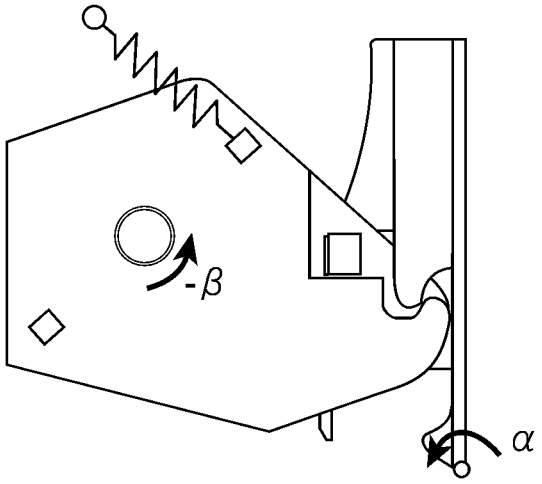

On the other hand, as the cover 215 is closed by a user, as shown in FIG. 9(*a*), after the cartridge replacement, the controlling surface 215*c* of the cover 215 is made to press the surface 216*d* of the cartridge guide 216, by the rotational movement of the cover 215 in the closing direction. Consequently, the cartridge guide 216 is moved in the direction −β against the resiliency of the first spring 222. As the cover 215 is rotated in the closing direction by the preset angle, the cartridge guide 216 rotationally moves beyond the image formation position.

Being freed from the surface 216*d*, the rotation controlling member 219 moves in the direction +X, shown in FIG. 7, preventing thereby the cartridge guide 216 from rotationally moving in the direction β, as in the first embodiment. Thereafter, as the cover 215 is rotationally moved further, the cover 215 stops controlling the movement of the cartridge guide 216, as shown in FIG. 9(*b*). Consequently, the surface 216*b* of the cartridge guide 216 is pressed on the controlling surface 219*c* of the rotation controlling member 219 by the resiliency of the first spring 222. Thus, the cartridge guide 216 is kept in the image formation position (first position) by the resiliency of the first spring 222.

In this embodiment, the cartridge mounting-dismounting mechanism is structured so that the cartridge guide 216 is rotationally moved by the opening movement of the door 215 into the position in which it allows a user to replace the development cartridge 211. Therefore, this embodiment is superior to the first embodiment in terms of the efficiency with which the development cartridge 211 is replaceable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-018378 filed on Feb. 3, 2014, which is hereby incorporated by reference herein in its entirety.

What is claimed is:

1. An image forming apparatus for forming an image on a recording material, comprising:

a drum cartridge including an image bearing member;

a developing cartridge including developing means for developing the image formed on said image bearing member;

a cartridge mounting member to which said drum cartridge and said developing cartridge are detachably mountable;

a transfer roller for transferring a visualized image provided by said developing means on said image bearing member, onto the recording material fed along a feeding path; and an opening and closing cover provided across the feeding path from said image bearing member, wherein said transfer roller is mounted on said opening and closing cover, wherein a path of removing said detachable developing cartridge is accessed by opening said opening and closing cover with the path extending across the feeding path so as to permit said developing cartridge to pass through the feeding path without removing said drum cartridge.

2. An apparatus according to claim 1, wherein said cartridge mounting member is capable of moving said drum cartridge and said developing cartridge between a first position for forming the image on the recording material and a second position for permitting mounting and dismounting of said developing cartridge, and said developing means includes a developer carrying member, and wherein said developer carrying member is closer to said feeding path in the second position than in the first position.

3. An apparatus according to claim 1, wherein said cartridge mounting member is capable of moving said drum cartridge and said developing cartridge between a first position for forming the image on the recording material and a second position for permitting mounting and dismounting of said developing cartridge, and said developing means includes a developer carrying member, and wherein said developer carrying member arranged in the second position is more upstream with respect to a rotational moving direction of said image bearing member than said developer carrying member arranged in the first position.

4. An apparatus according to claim 1, wherein said image bearing member is a photosensitive drum, and said developing means is a developing roller.

5. An apparatus according to claim 3, wherein said cartridge mounting member is provided with a guide portion for permitting mounting and dismounting of said drum cartridge and said developing cartridge in the same direction, when said drum cartridge and said developing cartridge are arranged in the second position.

6. An apparatus according to claim 1, wherein said cartridge mounting member is rotated about a predetermined position.

7. A apparatus according to claim 2, wherein a center of said developing means is disposed on the same side as the feeding path with respect to a line passing through a center of said image bearing member and parallel with a feeding direction of the recording material when said drum cartridge and said developing cartridge are arranged in the second position.

8. An apparatus according to claim 2, wherein said cartridge mounting member is movable from a position corresponding to the first position to a position corresponding to the second position.

9. An apparatus according to claim 8, further comprising urging means for urging said cartridge mounting member in a direction from the position corresponding to the first position toward the position corresponding to the second position.

10. An apparatus according to claim 2, further comprising switching means for switching between the first position and the second position.

* * * * *